US007004196B2

(12) United States Patent
Schubmehl et al.

(10) Patent No.: US 7,004,196 B2
(45) Date of Patent: Feb. 28, 2006

(54) DISPOSABLE CONTAINER FOR USE IN FLUID PROCESSING

(75) Inventors: Barry F. Schubmehl, Seattle, WA (US); Patrick Lansky, San Diego, CA (US)

(73) Assignee: Stedim, Inc., Concord, CA (US)

( * ) Notice: Subject to any disclaimer, the term of this patent is extended or adjusted under 35 U.S.C. 154(b) by 273 days.

(21) Appl. No.: 10/434,974

(22) Filed: May 9, 2003

(65) Prior Publication Data

US 2004/0221897 A1 Nov. 11, 2004

(51) Int. Cl.
*F17D 1/00* (2006.01)

(52) U.S. Cl. ..... 137/574; 137/573; 137/602; 137/592

(58) Field of Classification Search ..... 137/573, 137/574, 590, 592, 602
See application file for complete search history.

(56) References Cited

U.S. PATENT DOCUMENTS

| | | | | | |
|---|---|---|---|---|---|
| 592,721 | A | * | 10/1897 | Barnhart et al. | 137/573 |
| 2,021,616 | A | * | 11/1935 | Stuart | 137/574 |
| 2,047,539 | A | * | 7/1936 | Wolf | 137/573 |
| 2,128,617 | A | * | 8/1938 | Lawlor | 137/592 |
| 2,788,642 | A | * | 4/1957 | Burkhead et al. | 137/573 |
| 3,291,456 | A | * | 12/1966 | Deane | 137/602 |
| 3,343,565 | A | * | 9/1967 | Johnson | 137/592 |
| 3,799,508 | A | * | 3/1974 | Arnold et al. | 366/175.2 |
| 4,127,143 | A | * | 11/1978 | Zinga | 137/592 |
| 6,817,376 | B1 | * | 11/2004 | Morgan et al. | 137/573 |

* cited by examiner

*Primary Examiner*—John Rivell
(74) *Attorney, Agent, or Firm*—H. Michael Brucker

(57) ABSTRACT

A flexible, disposable container used in fluid processing apparatus including flow control means to promote mixing of fluid within the flexible container.

20 Claims, 6 Drawing Sheets

DISPOSABLE CONTAINER FOR USE IN FLUID PROCESSING

BACKGROUND AND SUMMARY OF THE INVENTION

The present invention relates to apparatus used in fluid processing such as diafiltration and concentration, as exemplified by protein or nucleic acid purification applications.

The basic equipment used in fluid processing such as diafiltration and concentration procedures includes a container (reservoir) holding the fluid material being processed, a pump, and tubing circulating the fluid material from the container through a filter and back into the container. An auxiliary source of additional fluid material (buffer) may also be present to add material to the container.

The current practice in the art is to use a rigid, reusable container as the reservoir to hold the fluid material and buffer, and to provide a physical place for mixing with a stirbar or impeller. Between uses, the rigid reusable reservoir and any associated stirring or mixing apparatus must be carefully cleaned and decontaminated. The cleaning process is time-consuming and always a potential for contamination.

The present invention eliminates entirely the rigid, reusable container and associated mixing apparatus and provides in its palace a unique flexible, disposable reservoir formed to induce mixing of fluids as they travel through the reservoir without the use of a stirbar, impeller or other mechanical mixing device.

The reservoir of the present invention not only provides an advantageous substitute for the standard rigid, reusable reservoir, but also provides a container in which the processed fluid can be stored and transported.

Accordingly, it is an object of the present invention to provide a disposable reservoir for use in fluid processing such as diafiltration and concentration.

Another object of the present invention is to provide such a reservoir which induces material mixing without the use of mechanical stirring devices.

Yet another object of the present invention is provide such a reservoir which is formed from an inexpensive disposable material that can serve as a container for storing and/or transporting the processed material.

The foregoing and other objectives, features and advantages of the invention will be more readily understood upon consideration of the following detailed description of the invention taken in conjunction with the accompanying drawings.

DETAILED DESCRIPTION OF THE PREFERRED EMBODIMENTS

Figure 1:
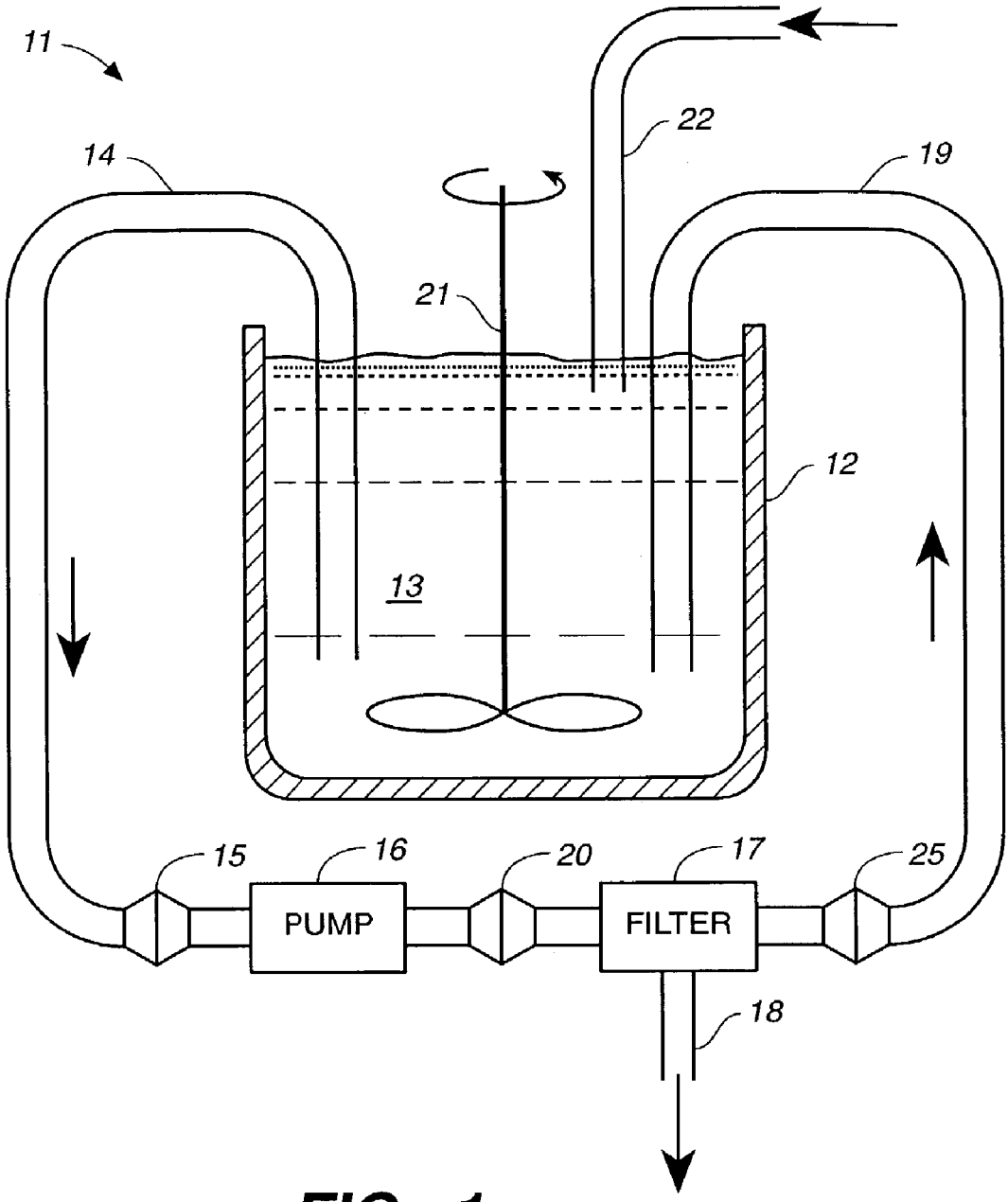
FIG. 1 (PRIOR ART)
FIG. 1 is a schematic illustration of prior art fluid processing apparatus using a rigid, reusable container as the fluid reservoir.

Referring to FIG. 1, basic prior art apparatus 11 for fluid processing such as diafiltration, concentration, purification, tangential flow filtration, and the like includes a rigid, reusable, open container 12 holding a quantity of fluid 13 to be processed. The fluid 13 is drawn out of container 12 through a tube 14 by a pump 16 connected to tube 14 by a connector 15. The pump 16 delivers fluid 13 to a filter 17 (connected to a pump 16 by a connection 20) where certain components of the fluid 13 are separated and discharged through a waste gate 18. The remaining components of the fluid 13 are returned from the filter 17 to the container 12 via tube 19 to which the filter is connected by a connector 25. A mechanical mixing device 21 continuously stirs or mixes the fluid 13 in container 12 so that the fluid 13 flowing in tube 14 is a substantial admixture of the fluid 13 in the container 12. Additional fluid can be added to the container 12 from a buffer reservoir (not shown) through a buffer tube 22.

With such prior art apparatus, it is necessary to carefully clean and decontaminate the reusable container 12 and mixing apparatus 21 after each use. Once the fluid 13 is processed, it is necessary to transfer it out of container 12 to an other container (not shown) in which it can be stored and/or transported.

Figure 2:
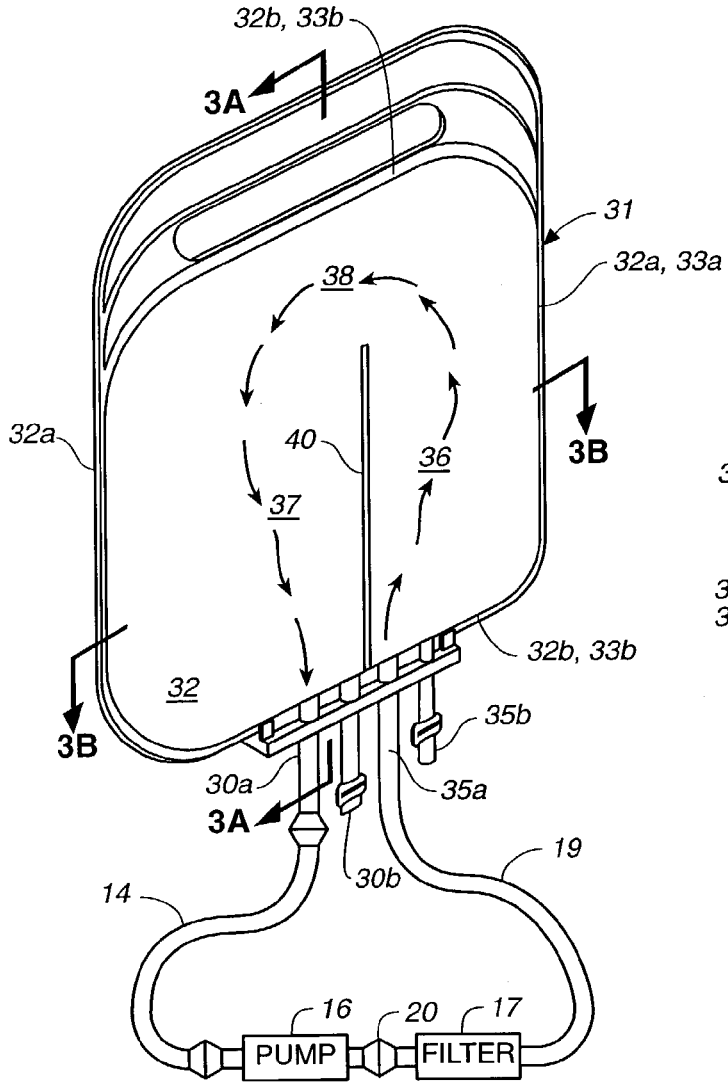
FIG. 2 is a perspective view of a first embodiment of the flexible, disposable reservoir of the present invention.
Figure 3A:
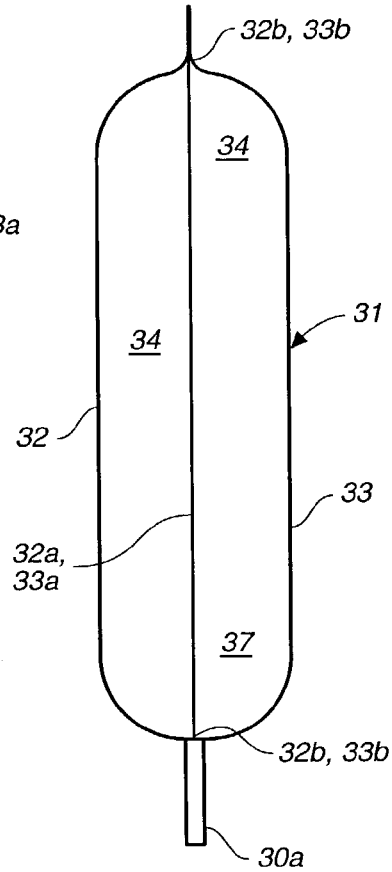
FIG. 3A is a sectional view of the invention taken along the line 3A—3A of FIG. 2.
Figure 3B:
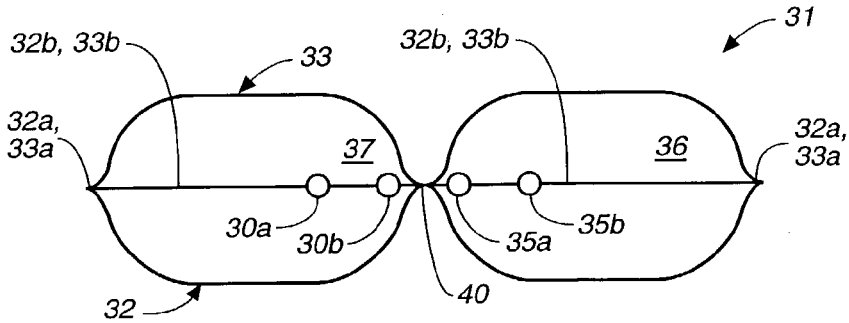
FIG. 3B is a sectional view taken along the line 3B—3B of FIG. 2.

Referring to FIGS. 2, 3A and 3B, a flexible bag 31 of the present invention replaces the container 12 (FIG. 1) as the fluid reservoir and mixing station. The bag 31 is preferably made from any of the following materials, alone or in any combination as a multi-layer film:

- ethylene vinyl acetate (EVA)
- low or very low-density polyethylene (LDPE or VLDPE)
- ethyl-vinyl-alcohol (EVOH)
- polypropylene (PP), all of which are well known in the art. Where required the bag 31 can be sterile. Such bags are available from a number of sources, including Stedim, Inc. under its trademark Flexboy®.

Bag 31 is formed by a front panel 32 and a back panel 33. Front panel 32 is defined by opposing side edges 32*a* and opposing end edges 32*b*. Back panel 33 is defined by opposing side edges 33*a* and opposing end edges 33*b*. Front panel 32 and back panel 33 are sealed along their side edges 32*a* and 33*a* and edges 32*b* and 33*b* by any of several methods known to those skilled in the art such as heat sealing. The panels 32 and 33 so sealed define a sealed interior chamber 34.

Four tube ports 30*a*, 30*b*, 35*a* and 35*b* are disposed in one end edge 32*b*–33*b* of bag 31 and communicate with the fluid chamber 34 and provide channels through which fluid can be introduced into and removed from the fluid chamber 34. While four ports 30*a*, 30*b*, 35*a* and 35*b* are shown, when the process only requires that a fluid be circulated out of fluid chamber 34 through an output port and eventually returned to the chamber through an input port (no addition of buffer fluid), two ports 30*a* and 35*a* are all that are required and the other ports can be eliminated altogether or simply sealed shut (as shown) in any one of several ways well known in the art.

Figure 4:
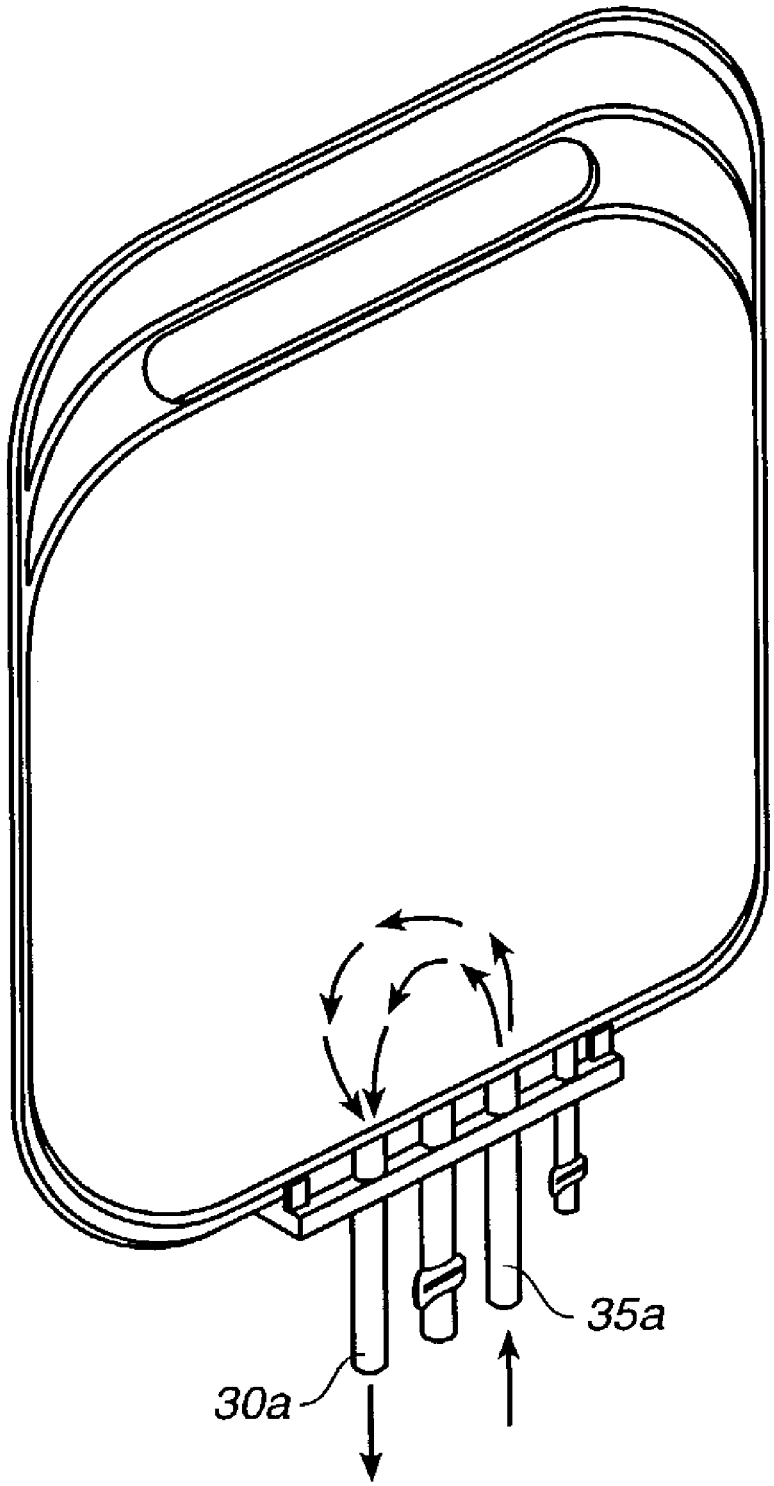
FIG. 4 (PRIOR ART)
FIG. 4 is a perspective view of a prior art bag without the additions of the present invention.

Referring to FIG. 4, if an unmodified bag 31 is used, and if fluid is pumped into port 35*a*, for example, and pumped out of a port 30*a*, the fluid in the chamber 34 of bag 31 will tend to stratify, with the fluid furthest from the ports prone to remain static and not leave the bag 31. To prevent this undesirable effect, the present invention provides fluid flow control means within bag 31.

Referring once again to FIGS. 2. 3A and 3B, in one embodiment of the present invention, fluid chamber 34 of bag 31 is divided to form an entrance chamber 36, an exit chamber 37 and a connecting chamber 38. The chambers 36 and 37 are separated by a baffle 40 between the ports 30*a* and 35*a* which extends from the end edge 32*b*–33*b* containing ports 30*a* and 35*a* to a point short of the opposing end edge 32*b*–33*b* and preferably more than 50% of the way to such opposing end edge. The chamber 38 begins beyond the baffle 40 and provides a fluid channel between chambers 36 and 37.

Fluid pumped into port 35*a* will enter chamber 36 and be restricted thereto until it reaches the connecting chamber 38 from which it can then travel to output port 30*a* through chamber 37. By so controlling and directing the flow of fluid 13 through the bag 31, the fluid is mixed such that the fluid exiting port 30*a* at any given time is substantially an admixture of all fluid in bag 31 at that time. In this way, all of the fluid is processed.

Where the process requires the introduction of a buffer fluid or any other fluid during processing, it can be introduced at the second entrance port 35*b*. Port 30*b* provides a second or alternative output port where called for by a particular process.

In one embodiment of the present invention, the baffle 40, as illustrated in FIGS. 2 and 3B, is formed by a weld that connects panel 32 to panel 33 along a line that extends from end edge 32*b*–33*b* between the ports 30*b* and 35*a* and extends toward the opposing end 32*b*–33*b*, but short thereof. The relative sizes and locations of the chambers 36, 37 and 38 can vary, depending on the fluid being processed and the process being carried out. In all cases, however, the interior chambers include fluid flow control means which cause mixing and the involvement of substantially all of the fluid in bag 31 while permitting the continuous flow of fluid between input port 35*a* and output port 30*a*.

The filter 17 can be pre-attached to the bag 31 and disposable therewith. Filters suitable for this embodiment of the invention include those ultrafiltration or microfiltration devices manufactured by Pall Corp., Millipore Corp., Sartorius, Amersham Biosciences, as well as others.

Figure 5:
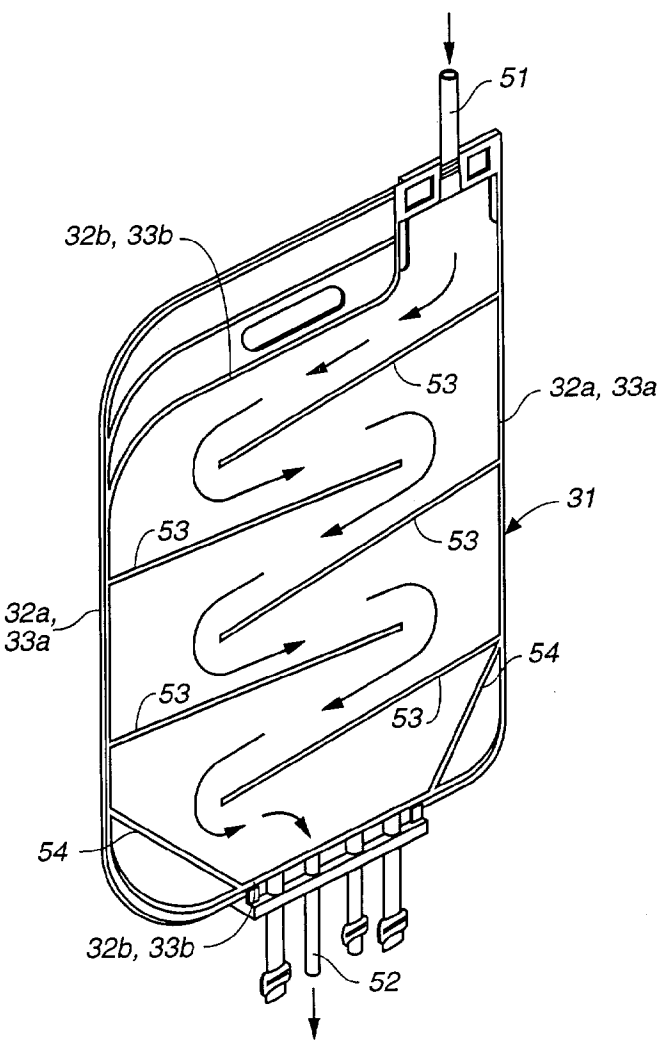
FIG. 5 is a perspective view of an alternative embodiment of the flexible, disposable reservoir of the present invention.

Referring to FIG. 5, in an alternative embodiment, bag 31 has an input port 51 at one end edge 32*b*–33*b* and an output port 52 at the opposing end edge 32*b*–33*b*. To promote mixing of the fluid in bag 31 as it travels from input port 51 to output port 52, one or more baffles 53 extend from one side edge 32*a*–33*a* toward, but not all the way to, the opposing side edge 32*a*–33*a*. Where more than one baffle 53 is involved, they can advantageously alternate, extending from opposing side edges 32*a*–33*a*. Baffles 53 require that fluid entering input port 51 take a circuitous route (so indicated by flow arrows) to reach output port 52 and, in the process, promote mixing in bag 31. In one embodiment, the baffles 53 are welds connecting the front panel 32 to the back panel 33 along a line. Forming such welds is well known in the art and, thus, need not be explained herein.

In addition to baffles 53, it is advantageous to include corner baffles 54 at the bag corners nearest output port 52 to prevent fluid from getting "caught" in the corners of bag 31 adjacent output port 52.

Figure 6:
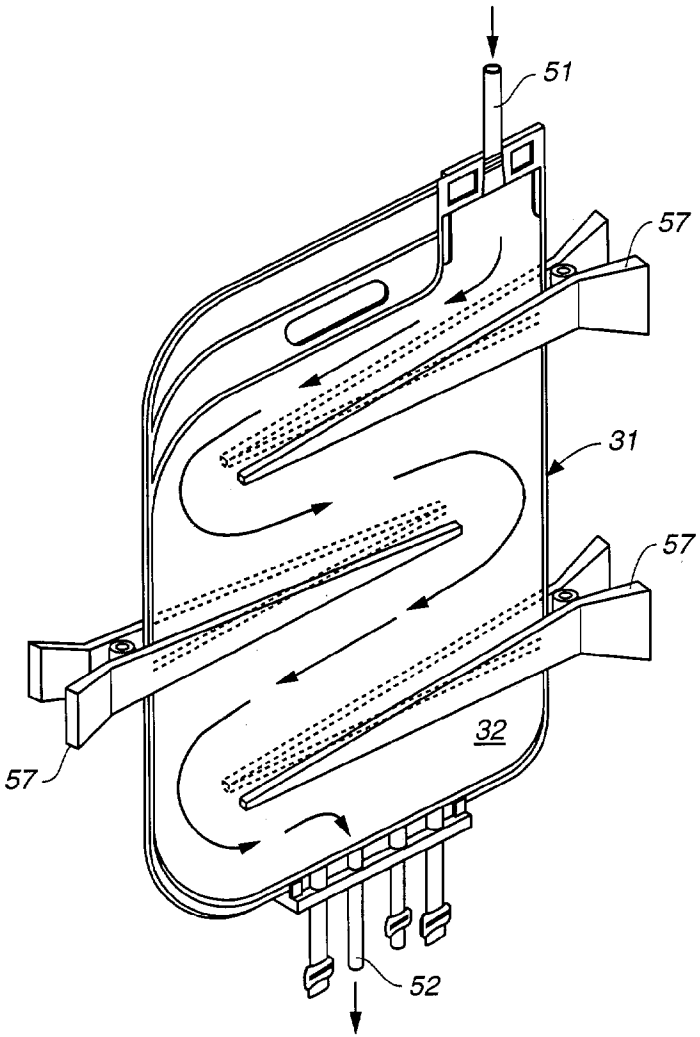
FIG. 6 is a perspective view of another embodiment of the flexible, disposable reservoir of the present invention.

Referring to FIG. 6, the baffles 53 described with reference to FIG. 5 are, in this embodiment, provided by exterior clamps 57 which are applied to the bag during the processing of the fluid to promote fluid flow that mixes the fluid within bag 31. Clamps 57 can be removed after processing is completed and the bag used for storage and/or transportation of the processed fluid. Like the welds of FIG. 5, the clamps 57 connect the front panel 32 to the back panel 33 along lines. In this embodiment, the connection is temporary and both the number and locations of clamps 57 are a matter of choice to best meet the needs of the process.

Figure 7:
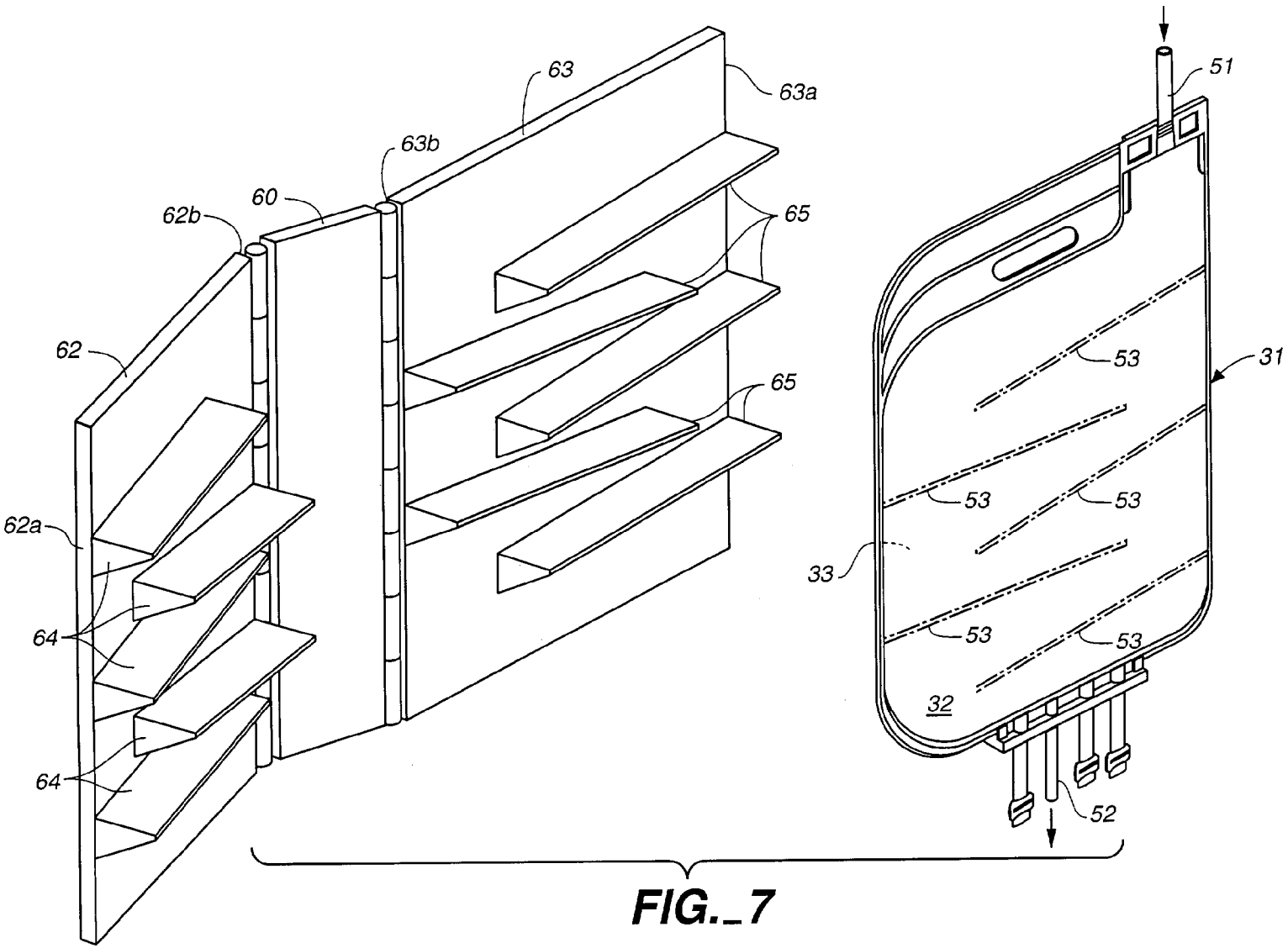
FIG. 7 is yet another alternative embodiment of the invention.

Referring to FIG. 7, in yet another embodiment, baffles 53 (FIG. 5) are formed by a clamping mechanism 61 which comprises a pair of substantially rectangular frames 62 and 63 which are joined at a hinge 60 to form a "book frame." Frame 62 includes side members 62*a* and 62*b*. One or more baffle-forming bars 64 extend from side member 62*a* of frame 62 toward, but not all the way to, opposing side member 62*b*. Where multiple baffle-forming bars 64 are employed, they can advantageously extend alternatively from side member 62*a* and side member 62*b* of frame 62.

Frame 63 includes side members 63*a* and 63*b*. One or more baffle-forming bars 65 extend from side member 63*a* of frame 63 toward, but not all the way to, opposing side member 63*b*. Where multiple baffle-forming bars 65 are employed, they can advantageously extend alternatively from side member 63*a* and side member 63*b* of frame 63.

To form the fluid-controlling baffles 53, the bag 31 is disposed within the book frame clamp 61 and the frame is secured closed, causing the bars 64 and 65, which are aligned, to pressure bag panel 32 against bag panel 33 along lines 53 defined by the bars 64 and 65.

Figure 8:
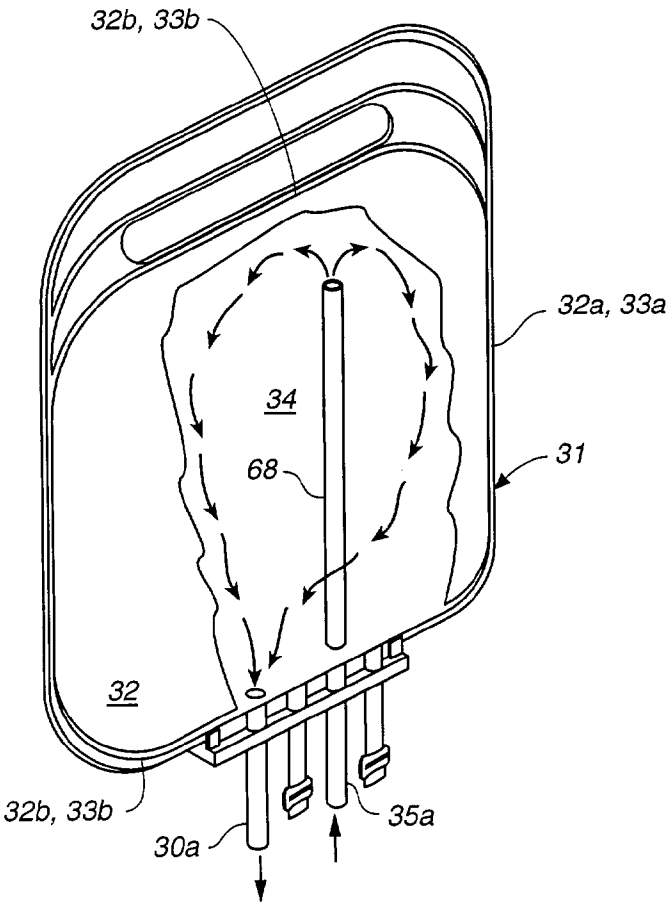
FIG. 8 is a perspective view of another embodiment of the invention.

Referring to FIG. 8, in another embodiment, fluid control means for promoting mixing within bag 31 is provided by a dip tube 68, which is connected to input port 35*a* and extends into the interior chamber 34 of bag 31. Preferably, dip tube 68 extends at least halfway to the opposing end edge 32*b*–33*b*, but sufficiently short of that opposing end edge to permit fluid to freely flow out of the dip tube and back toward the outlet port 30*a*. Once again, the fluid flowing in input port 35*a* is prevented from traveling directly to outlet port 30*a*, but rather takes a route that promotes mixing of the fluid within the chamber 34.

Figure 9:
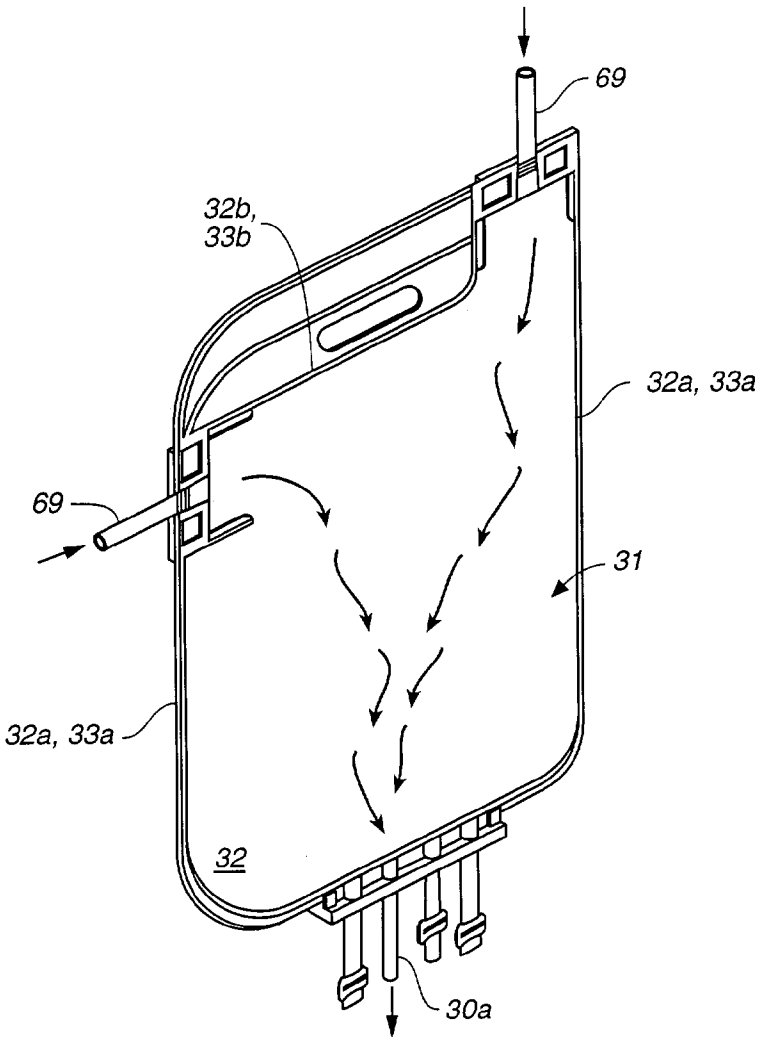
FIG. 9 is a perspective view of another alternative embodiment of the invention.

Referring to FIG. 9, in another embodiment of the invention, fluid is introduced into the bag 31 by a plurality of inlet ports 69 (only two of which are shown): one at a side edge 32*a*–33*a* and one at end edges 32*b*–33*b* opposite the outlet port 30*a*. By simultaneously introducing fluid into the bag 31 from a plurality of inlet ports 62 where those inlet ports are relatively remote from the outlet port 30*a*, the flow of fluid between the inlet ports 62 and the outlet port 30*a* promotes sufficient mixing to satisfy the needs of many fluid processes.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A closed sterilizable disposable fluid container for use in fluid processing where fluid flows into and out of the container, comprising in combination:

a bag constructed of flexible material defining an interior chamber which can retain fluid wherein said bag is further described as having a front panel defined by opposing end edges and opposing side edges, and a back panel defined by opposing end edges and opposing side edges, with the end edges of said front panel sealed to the end edges of said back panel to form opposing bag end edges, and the side edges of said front panel are sealed to the side edges of said back panel to form opposing bag side edges wherein said bag end edges and said bag side edges define the borders of the interior chamber;

at least one inlet port through which fluid can flow into the interior chamber of said bag;

at least one outlet port through which fluid can flow out of the interior chamber of said bag;

fluid flow control means between said inlet port and said outlet port preventing the direct passage of fluid from said inlet port to said outlet port wherein said flow control means is further described as at least one or more baffles formed by lines of contact between said front panel and said back panel that create an indirect flow path within said bag between said inlet port and said outlet port and promote mixing of fluid in said bag with fluid flowing in said inlet port.

2. The container of claim 1 wherein said fluid flow control means is further described as causing fluid flowing into said inlet port to mix with fluid in said bag whereby the fluid flowing out of said outlet port at any given time is a substantial admixture of all the fluid in the bag at that time.

3. The container of claim 1 wherein said baffles are formed by one or more clamps causing one or more lines of contact between said front panel and said back panel.

4. The container of claim 1 wherein said baffles are formed by heat seals causing one or more lines of contact between said front panel and said back panel.

5. The container of claim 1 wherein said baffles are formed by a book frame clamp causing one or more lines of contact between said front panel and said back panel.

6. The container of claim 1 wherein said inlet port and said outlet port are located on the same edge of said bag; and a said baffle extends between said inlet port and said outlet port from said same edge to a point at least halfway to the edge opposite said same edge.

7. The container of claim 1 wherein said inlet port and said outlet port are located on opposing end edges of said bag; and at least one said baffle extends from a said side edge of said bag toward, but not to, the opposite said side edge.

8. The container of claim 7 wherein there are a plurality of said baffles with one or more extending from each of said side edges.

9. The container of claim 1 further comprising a disposable filter connected to said outlet port.

10. The container of claim 1 wherein there are two inlet ports with one located at a said end edge and one located at a said side edge.

11. In a fluid processing system that circulates fluid from a reservoir through a filter and back to the reservoir, the improvement comprising;

a reservoir bag constructed of flexible material defining an interior chamber which can retain fluid wherein said bag is further described as having a front panel defined by opposing end edges and opposing side edges, and a back panel defined by opposing end edges and opposing side edges, with the end edges of said front panel sealed to the end edges of said back panel to form opposing bag end edges, and the side edges of said front panel are sealed to the side edges of said back panel to form opposing bag side edges wherein said bag end edges and said bag side edges define the borders of the interior chamber;

at least one outlet port through which fluid can flow out of the interior chamber of said bag;

at least one inlet port through which fluid can flow into the interior chamber of said bag;

fluid tubes connecting said inlet port to the filter; and fluid flow control means between said inlet port and said outlet port preventing the direct passage of fluid in said bag from said inlet port to said outlet port wherein said flow control means is further described as at least one or more baffles formed by lines of contact between said front panel and said back panel that create an indirect flow path within said reservoir bag between said inlet port and said outlet port and promote mixing of fluid in said bag with fluid flowing in said inlet port.

12. The fluid processing system of claim 11 wherein said fluid flow control means is further described as causing fluid flowing into said inlet port to mix with fluid in said bag whereby the fluid flowing out of said outlet port at any given time is a substantial admixture of all the fluid in the bag at that time.

13. The fluid processing system of claim 11 wherein said baffles are formed by one or more clamps causing one or more lines of contact between said front panel and said back panel.

14. The fluid processing system of claim 11 wherein said baffles are formed by heat seals causing one or more lines of contact between said front panel and said back panel.

15. The fluid processing system of claim 11 wherein said baffles are formed by a book frame clamp causing one or more lines of contact between said front panel and said back panel.

16. The fluid processing system of claim 11 wherein said inlet port and said outlet port are located on the same edge of said bag; and a said baffle extends between said inlet port and said outlet port from said same edge to a point at least halfway to the edge opposite said same edge.

17. The fluid processing system of claim 11 wherein said inlet port and said outlet port are located on opposing end edges of said bag; and at least one said baffle extends from a side edge of said bag toward, but not to, the opposite side edge.

18. The fluid processing system of claim 17 wherein there are a plurality of said baffles with one or more extending from each of the side edges.

19. The fluid processing system of claim 11 wherein there are two inlet ports with one located at a said end edge and one located at a said side edge.

20. The fluid processing system of claim 11 wherein the filter is disposable.

* * * * *